United States Patent [19]

DiRico

[11] Patent Number: 4,685,414

[45] Date of Patent: Aug. 11, 1987

[54] COATING PRINTED SHEETS

[76] Inventor: Mark A. DiRico, 416 Adams St., Quincy, Mass. 02169

[21] Appl. No.: 719,474

[22] Filed: Apr. 3, 1985

[51] Int. Cl.[4] ..... B05C 1/08; B05C 11/10

[52] U.S. Cl. ..... 118/46; 118/211; 118/262

[58] Field of Search ..... 118/46, 262, 261, 211; 101/352

[56] References Cited

U.S. PATENT DOCUMENTS

| | | | |
|---|---|---|---|
| 1,623,280 | 4/1927 | Smith et al. | 118/262 X |
| 3,768,438 | 10/1973 | Kumpf | 118/211 |
| 4,147,126 | 4/1979 | Riggs | 118/227 |
| 4,270,483 | 6/1981 | Butler et al. | 118/46 |
| 4,329,387 | 5/1982 | Goodrich et al. | 428/196 |
| 4,399,767 | 8/1983 | Simeth | 118/46 |
| 4,527,479 | 7/1985 | Dahlgren et al. | 101/450.1 |

FOREIGN PATENT DOCUMENTS

| | | | |
|---|---|---|---|
| 1123267 | 5/1982 | Canada | 101/352 |
| 2068298 | 8/1981 | United Kingdom | 101/352 |

OTHER PUBLICATIONS

Booth, G. L., "Coating Equipment and Processes", New York, Lockwood Publishing Co., Inc., 1970, pp. 149–153.

*Primary Examiner*—Evan K. Lawrence

[57] ABSTRACT

Apparatus for applying a liquid coating to the surface of a sheet workpiece and adapted for operation on-line with the last unit of a lithographic sheet printing press. The apparatus comprises: (1) a textured metering roller in a mount which is linearly movably attached to a support platform fixed adjacent the press unit, and extending between the last press unit and a remote point. The support platform allows movement of the metering roller and the mount between a first position in which the mount is continuously adjustably biased against the last press unit, and a second position, away from the last press unit to allow use of the last press unit as a lithographic press. The platform comprising longitudinal supports arranged generally perpendicular to a vertical plane through the axis of said metering roller, and the metering roller mount is movably supported and guided along the supports.

In the first position, the metering roller continuously delivers a smooth, uniform, metered amount of liquid material to the blanket roller of the printing press. The apparatus also includes a latch that allows the mount, with its attached metering roller, liquid coating supply, and metering roller rotation device, to be readily detached from and moved out of the way of the press unit, so that the press unit can be used as a lithographic press unit. A biasing latch and an adjustable stop allow the metering roller and mount to be readily and reliably returned, locked and biased in the first position.

8 Claims, 4 Drawing Figures

FIG 1
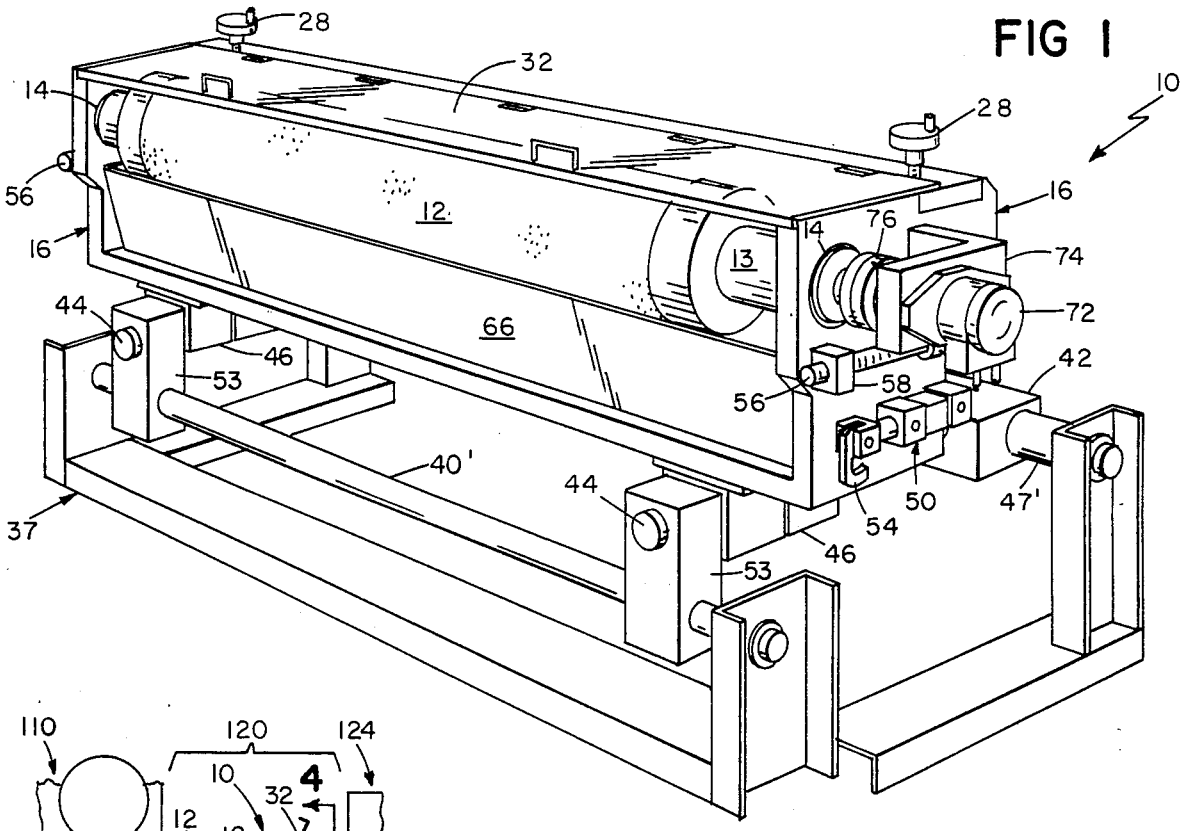
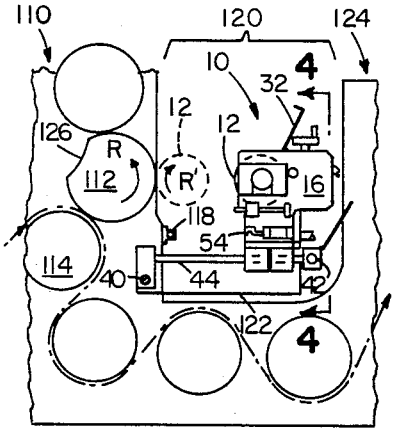
FIG 3
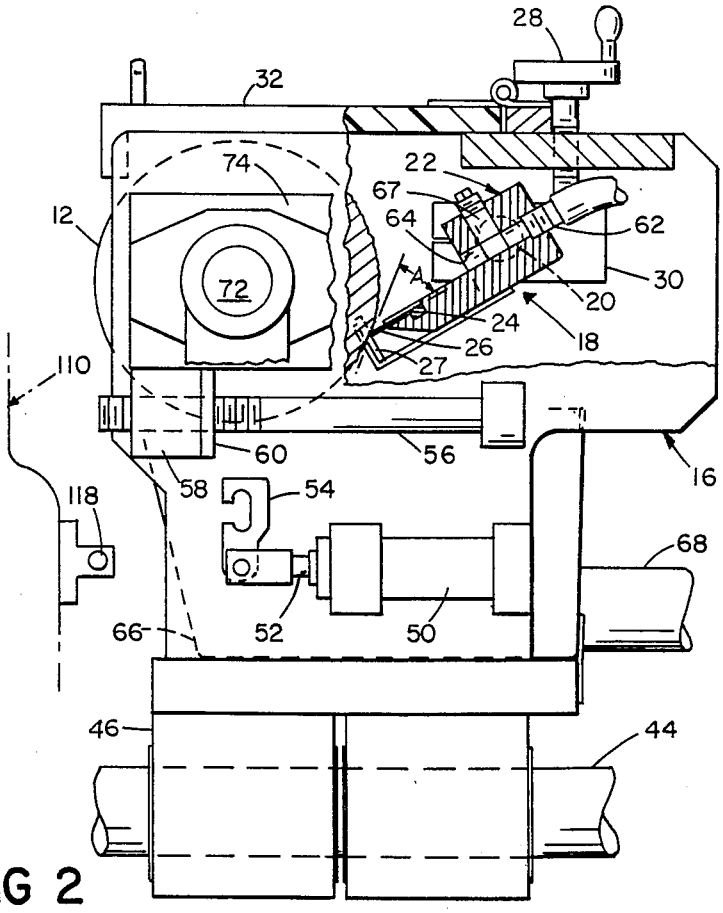
FIG 2

COATING PRINTED SHEETS

BACKGROUND OF THE INVENTION

This invention relates to coating printed sheets.

In many applications it is desirable to apply a coating to a printed sheet. For example, a water soluble polymer finish may be applied to a workpiece printed by offset lithography to "dry" the sheet quickly by coating the surface while it is still tacky. This coating avoids the need for powder driers that may be cumbersome or air drying procedures that may be slow. Coatings are also useful for providing a glossy finish that improves the rub-resistance of the workpiece and improves its overall appearance. Finally, adhesive coatings may be applied to printed packaging; for example, heat-set adhesives may be applied to enable attachment of a feature such as the clear plastic bubble of a package used to display the product.

Application of coatings to a workpiece is made difficult by various requirements. For example, the coating should be uniform and its thickness should be controlled. Moreover, the coating should be applied quickly, before its vehicle evaporates causing it to thicken. Finally, it is desirable for the coater to operate "on-line" with the press that prints the workpiece to take full advantage of the fast-drying capability of coatings and generally to simplify the manufacture of printed coated workpieces.

Butler U.S. Pat. No. 4,270,483 discloses an on-line coating apparatus for attachment to a conventional offset lithographic printing press. The apparatus includes a set of rollers (i.e. pick-up roller 14 and application roller 16) to deliver coating material from a reservoir 18 to a blanket roll 108. A metering rod 40 meters the amount of coating transferred to application roller 16.

An on-line coater sold by Norton Burdett Co. of Nashua, N.H. has a single roller driven directly by a D.C. motor. The roller is a gravure cylinder that transfers coating to a blanket cylinder. The coater is attached to a pivoting arm, and the unit can be pivoted away from the press unit when the coater is not in use.

Another on-line coater, sold by IVT Colordry, Inc. of Fairfield, Conn., applies coating from a reservoir pan to a blanket cylinder using a pick-up roller that delivers a metered coating supply to an applicator roller; the applicator roller applies the coating to the blanket cylinder of a press unit.

Kumpf U.S. Pat. No. 3,768,438 discloses a coater in which a fountain roller dips into a coating reservoir and transfers liquid coating material to a feed roller. The feed roller in turn transfers coating material to a coating roller that coats a sheet fed between the coating roller and a format roller.

SUMMARY OF THE INVENTION

The invention generally features apparatus to be mounted on-line with a printing press unit for coating the surface of a sheet workpiece with liquid material. The coating apparatus comprises a textured (e.g., engraved) metering roller or cylinder rotably mounted to be forced against the blanket roller of the press unit. A doctor assembly comprising an elongated blade edge is positioned against the engraved roller surface, and includes means to deliver the liquid material to the longitudinal engraved surface of the roller. The engraved metering roller delivers a metered amount of the liquid to the blanket roller, which transfers the liquid material to the sheet workpiece.

Preferred embodiments of the apparatus include the following features. A hydraulic cylinder mounted on the coating apparatus pulls a piston rod that is clamped to the press unit, thus forcing the metering roller against the blanket roller. The printing press is an offset lithographic press having an indented region on the blanket roller surface, and the mounting means includes a stop to limit movement of the metering roller toward that indented region. The mounting means is movably attached to a platform so the coating apparatus is moveable away from the printing press unit when the coating apparatus is not in use. Specifically, the mounting means has bearings that slide along longitudinal support rails arranged to be generally perpendicular to a vertical plane through the metering roll axis. The doctor assembly includes means to deliver liquid coating from a liquid coating reservoir to an outlet positioned to deliver coating liquid to a central portion of the engraved surface adjacent the doctor blade; the outlet is positioned so that as the metering roll rotates, coating delivered from the outlet encounters the doctor blade before it encounters the blanket roller. The position of the doctor blade can be adjusted relative to the metering roll surface. A drip pan positioned below the doctor blade has an outlet to drain and recirculate coating material that flows from the ends of the metering roller and doctor assembly. A hydraulic motor is mounted to drive the metering roller directly, rotating it in a predetermined rotational direction.

The apparatus provides a compact, versatile and reliable means for coating printed sheets. Specifically, the apparatus can be added to an existing press unit without significant modification to the unit; and once added, the apparatus can be moved out of the way so that the press unit to which it is attached can be used for printing. This is particularly useful when the number of colors to be printed requires the use of the press unit to which the coater is attached.

The apparatus is capable of delivering a metered amount of coating to the blanket roller without the use of bulky complex metering systems and without serious clogging of the coating flow path. Versatility is achieved by using the blanket roller of an existing press unit, yet the apparatus can be detached easily from the press unit and moved out of the way. At the same time, when it is in use, the apparatus is stable and provides a steady even pressure against the blanket roller, notwithstanding the considerable range of forces and vibrations to which the metering roller is subject. The apparatus accommodates indentations in the blanket roller without suffering uneven compressive forces that could "squeeze" liquid coating from the blanket and cause streaking. Finally, the use of the hydraulic assist motor with a direct drive enables a smooth start up, delivering an even amount of coating to the blanket roller quickly after start-up without streaking that can be experienced with other drive systems.

Other features and advantages of the invention will be apparent from the following description of the preferred embodiment and from the claims.

BRIEF DESCRIPTION OF THE DRAWINGS

FIG. 1 is a perspective view of a coating apparatus supported independently and not attached to a press unit.

FIG. 2 is a side view of the coater of FIG. 1, with parts broken away and in section, including a portion of an adjacent press unit.

FIG. 3 is a highly schematic representation of the coater of FIG. 1 attached to a press unit.

APPARATUS

Figure 4:
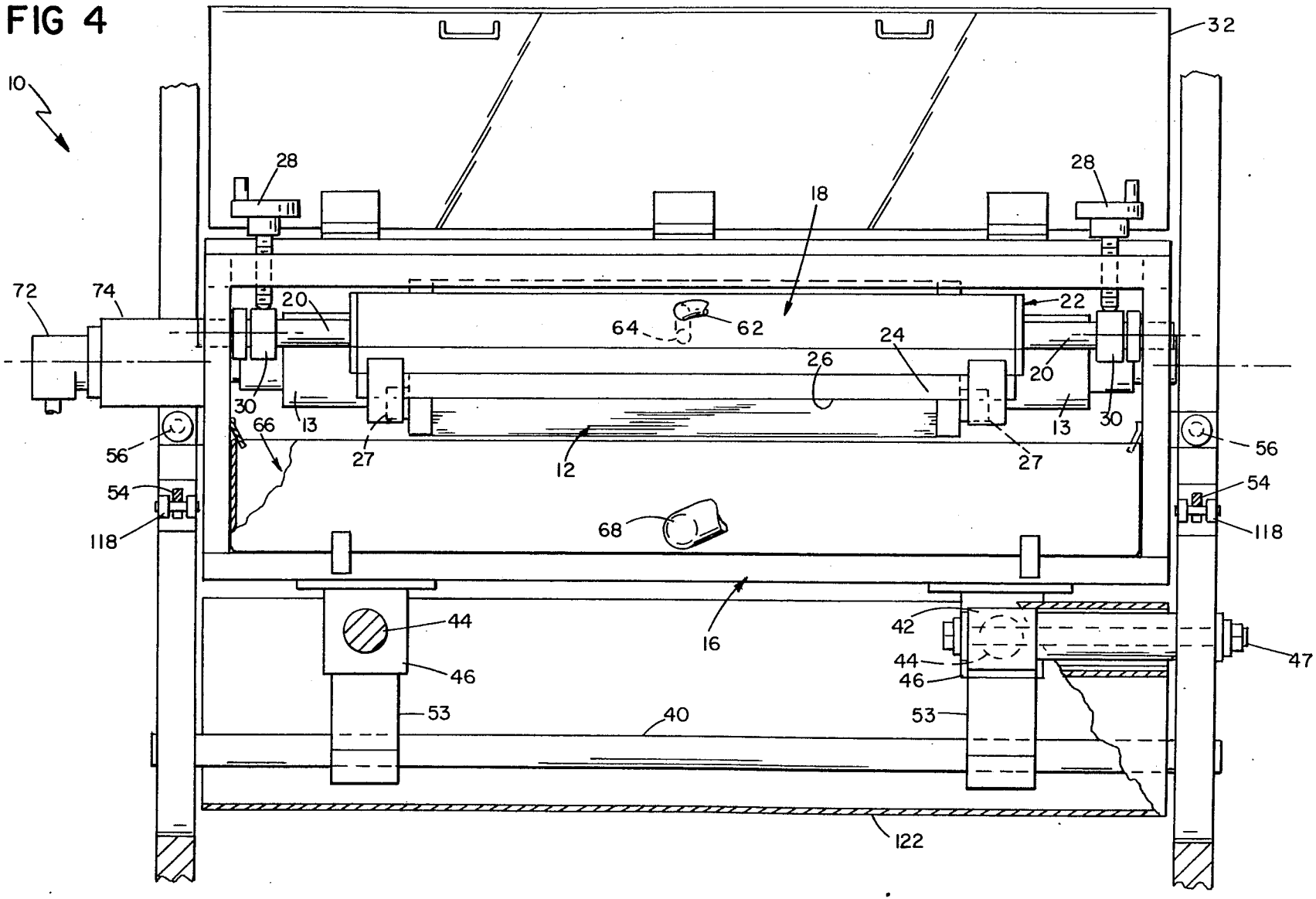
FIG. 4 is a rear view of the coater of FIG. 1 with parts broken away and in section.

FIG. 1 shows coating unit 10 separated from a press, as it would be in storage or in construction. As shown in FIGS. 2 and 3, coating unit 10 is adapted to attach to the most downstream unit 110 of a standard multi-unit offset lithograph press. Coating unit 10 has a single engraved roller 12 and shaft 13 rotably mounted on bearings 14 that are attached to a housing 16. When the coating unit is attached to press unit 110, the axis of roller 12 is parallel and horizontally aligned with the axis of blanket roller 112, and roller 12 contacts the blanket roller 112 so that roller 12 delivers liquid coating to blanket roller 112.

As shown best in FIG. 2, a doctor blade assembly 18 is adjustably mounted in housing 16 to deliver liquid coating to engraved roller 12 and to spread a metered level of the coating along the roller surface. Assembly 18 includes a rotably mounted axle 20 spanning housing 16 parallel to the longitudinal axis of roller 12. Mounted centrally on axle 20 is a rectangular housing 22 from which a blade clamp 24 extends. Doctor blade 26 is fixed in clamp 24 and is held against roller 12 at an angle. Blade 26 is blue spring steel about 0.007 inches thick, and it extends from clamp 24 about ½ inch. The set-up angle A (FIG. 2) is about 30°. Blade 26 is forced against roller 12 at a pressure of e.g. 25–30 pounds for a 60-inch blade (i.e. about 0.5 pounds per inch).

In FIG. 2, doctor blade assembly 18 also includes a fitting 62 communicating with a passage through doctor blade housing 22 to outlet 64. A plugged passage 67 in housing 22 allows access to the interior of the housing for cleaning. A drip pan 66 having an outlet 68 is positioned below roller 12 and doctor blade assembly 18.

Adjustment of blade 26 to roller 12 is achieved by two adjustment screws 28 which extend through the top of housing 16 at opposite ends thereof. Screws 28 extend to adjustment brackets 30 on axle 20. Because screws 28 are attached to brackets 30 at points off of the center of the axle 20, rotation of screws 28 will pivot axle 20 and brackets 30, changing the pressure between blade 26 and roller 12. Wipers 27 on assembly 18 at each end of roller 12 prevent liquid coating from building up on the ends of the roller 12.

Unit 10 also includes a clear cover 32 hinged to the top of housing 16 to protect roller 12.

As shown in FIGS. 3 and 4, housing 16 is movably mounted above the floor 122 of the well 120 between press unit 110 and downstream unit 124, which is, e.g., a rack for storing bundles of the finished workpieces. Specifically, housing 16 is mounted on bearing blocks 46 that slide on two parallel tie rods or rails 44 oriented perpendicular to the axis of roller 12. Rails 44 are supported at one end by blocks 53 that are adjustably mounted on cross shaft 40 of press unit 110. At their other ends, rails 44 are supported respectively by blocks 42 on shafts 47 fixed to press unit 110. As best shown in FIG. 3, shaft 40 and shafts 47 are integrated with the floor 122 of well 120. Shaft 40 is an existing shaft on unit 110. Shafts 47 are added to the unit to accommodate coater 10. (In FIG. 1, the coater 10 is shown separate from unit 110, as it might be stored or transported; rails 44 are supported by a frame 37 of metal beams that support shaft 40' and shafts 47').

Hydraulic cylinders 50 (one shown) are mounted on opposite sides of housing 16 to drive piston arms 52 and maintain proper pressure between roller 12 and roller 112. At one end of each piston arm 52 is a latch 54 that cooperates with a lug 118 on unit 110 to latch the coating unit to the press. Also fixed to each side of housing 16 is an adjustable stop screw 56 that is threaded through a block 58 and locked in place with lock nut 60. Cylinders 50 are connected to limit switches (not shown) to release the pressure between rollers 12 and 112 when the press is off impression.

On one side of housing 16 a hydraulic motor 72 is mounted to motor support 74 to drive roller 12 directly via coupling 76.

OPERATION

The coater is first locked into operation on press unit 110 by manually moving it along rails 44 toward unit 110 and rotating latch 54 to engage a lug on unit 110. In operation, when the press is off impression, hydraulic motor 72 rotates roller 12 as coating fluid is pumped under pressure from a fluid reservoir (not shown) to inlet opening 64 in the doctor blade assembly. From there, coating spreads over the engraved surface of roller 12 and is metered by the engraving and by doctor blade 26. A continuous flow of coating is maintained over the surface of roller 12, and excess coating is recovered through drip pan 66 and outlet 68 for recycling. In this way, sufficient flow is maintained to avoid clogging the flow path or roller with dried coating and to avoid starving the ends of the roller. The amount of coating carried by roller 12 can be adjusted by turning screw 28 to adjust the pressure between blade 26 and roller 12, as described above. When the press is on impression, hydraulic cylinders 50 serve to pull roller 12 against blanket roller 112 with a force that can be adjusted by adjusting the pressure in cylinders 50. As blanket rotates in direction R, friction turns roller 12 in the opposite direction R', without assistance from the motor 72.

As blanket roller 112 rotates, the indentation 126 on that roll encounters the nip between roller 12 and roller 112. It is undesirable to allow roller 12 to be forced into that indentation 126 by hydraulic cylinders 50. Stops 56 are adjusted to limit travel of coater housing 16 and prevent that from occurring. Stops can be finely adjusted to set the optimum pressure (for example about 40–50 pounds/linear inch) between roller 12 and roller 112.

A metered amount of liquid coating is delivered to blanket roller 112 at the nip between roller 112 and roller 12. Blanket roller 112 in turn delivers that coating to the workpiece as the workpiece travels through the nip between roller 112 and impression roller 114.

When the coater is not in use, latch 54 is released, and the coater is moved back along rods 44 away from roller 112.

More specifically, when using an acrylic water-based coating, a suitable engraved roller is a quadrangular cell cylinder, having about 165 lines/inch, each cell being about 60 microns in depth. Machine Engraving Division. Southern Gravure Service, Inc., Louisville, Ky., sells a suitable engraved roller. An acrylic water-based coating having about 25% solids can be applied to achieve a dry coat weight of 0.6–0.9 pounds using a roll speed of about 350 rpm.

OTHER EMBODIMENTS

Other embodiments are within the following claims. For example, other doctor blade arrangements can be used to meter the load on roller 12; such as a system having dual, parallel blades having a coating inlet between the two blades. Other types of engraved cylinders may be used. Other types of press units may be used in conjunction with the coater, but offset lithographic sheet-feeding units are preferred.

I claim:

1. Apparatus for applying a liquid coating to the surface of a sheet workpiece, said apparatus being adapted for operation on-line with the last unit of a lithographic sheet printing press, said unit comprising a blanket roller having a surface indentation, said coating application apparatus comprising:

(1) a metering roller rotatably mounted in mounting means, said metering roller having a textured longitudinal surface, said mounting means being linearly movably attached to a support platform fixed adjacent said last press unit, and extending between the last press unit and a point remote from said unit, allowing movement of said metering roller and said mounting means between a first position in which said mounting means is continuously adjustably biased against said last press unit wherein said metering roller surface contacts said blanket roller, and a second position, away from said last press unit to allow use of said last press unit as a lithographic press, said platform comprising longitudinal supports arranged generally perpendicular to a vertical plane through the axis of said metering roller, said metering roller mounting means being supported by, guided by and movable along said supports;

(2) latch means, attached to the mounting means and positioned to lock said metering roller mounting means to said press unit in said first position, said latch means comprising a biasing means to adjustably bias said metering roller mounting means against said press unit, providing a steady even pressure between said blanket roller and said metering roller, wherein said mounting means further comprises a continuously adjustable stop to position said metering roller against said blanket roller and to prevent travel of said metering roller toward said surface indentation of said blanket roller as said blanket roller rotates, said latch being movable to provide quick release of said mounting means from said press unit to allow movement along said supports to said second position; and (3) a metering member comprising means to control liquid coating on said textured metering roller surface;

(4) means attached to said mounting means to supply liquid coating material to the textured surface of said metering roller; and (5) means attached to said mounting means to effect rotation of said metering roller;

whereby in said first position, said metering roller continuously delivers a smooth, uniform, metered amount of said liquid material to said blanket roller, said blanket roller transferring said liquid material to said sheet workpiece, said latch allowing said mounting means, with its attached metering roller, liquid coating supply means, and metering roller rotation means, to be readily detached from and moved out of the way of the press unit, so that the press unit can be used as a lithographic press unit, and said latch means and adjustable stop allowing said metering roller and mounting means to be readily and reliably returned,locked and biased in the same said first position.

2. The apparatus of claim 1 wherein said metering member comprises a doctor assembly, said assembly comprising an elongated blade edge positioned against said textured roller surface, said assembly further comprising said means to deliver said liquid coating material to said textured roller surface.

3. The apparatus of claim 1 wherein said latch means comprises a cylinder attached to said mounting means that adjustably forces said mounting means against said press unit.

4. The apparatus of claim 1 wherein said longitudinal supports comprise rail members, and said mounting means comprises bearings that slide along said rail members.

5. The apparatus of claim 2 comprising a drip pan positioned below said doctor assembly attached to said mounting means, said drip pan comprising an outlet to drain and recirculate excess liquid coating material that flows from the ends of said metering roller, said doctor assembly comprising means to hold said elongated blade and adjust the blade pressure against the metering roller, said liquid coating delivery means comprising a centrally positioned outlet to deliver coating recirculated from said drip pan.

6. The apparatus of claim 3 wherein said latch means comprises a lug mounted on said press unit positioned to cooperate with said cylinder, said cylinder being a hydraulic cylinder, said latch further comprising a quick-release interconnect between said lug and said cylinder.

7. The apparatus of claim 6 wherein said latch means comprises a pivoting member that pivots between a first position attached to said lug and a second position that releases said coater from said press unit.

8. The apparatus of claim 7 wherein said latch means comprises a hook member configured to pivotally engage said lug on said press unit.

* * * * *